US010837463B2

(12) United States Patent
Hesami et al.

(10) Patent No.: US 10,837,463 B2
(45) Date of Patent: Nov. 17, 2020

(54) SYSTEMS AND METHODS FOR GAS PULSE JET PUMP

(71) Applicant: General Electric Company, Schenectady, NY (US)

(72) Inventors: Aboozar Hesami, Edmond, OK (US); Pejman Kazempoor, Edmond, OK (US); Victor Jose Acacio, Cypress, TX (US); Jeremy Daniel Van Dam, Edmond, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 384 days.

(21) Appl. No.: 15/604,252

(22) Filed: May 24, 2017

(65) Prior Publication Data

US 2018/0340551 A1 Nov. 29, 2018

(51) Int. Cl.
*F04F 5/24* (2006.01)
*F04F 5/46* (2006.01)
(Continued)

(52) U.S. Cl.
CPC ..... *F04F 5/24* (2013.01); *E21B 34/16* (2013.01); *F04F 5/44* (2013.01); *F04F 5/46* (2013.01); *F04F 5/468* (2013.01)

(58) Field of Classification Search
CPC ..... F04F 5/24; F04F 5/46; F04F 5/44; E21B 34/10; E21B 34/16; E21B 43/121;
(Continued)

(56) References Cited

U.S. PATENT DOCUMENTS 4,149,453 A * 4/1979 Reed ..... F23J 15/00 110/160
5,374,163 A * 12/1994 Jaikaran ..... E21B 23/02 166/105

(Continued)

FOREIGN PATENT DOCUMENTS

| | | |
|---|---|---|
| CN | 1145458 A | 3/1997 |
| JP | 2014-523989 A | 9/2014 |
| WO | 2009208037 A1 | 5/1992 |

OTHER PUBLICATIONS

International Search Report and Written Opinion issued in connection with corresponding PCT Application No. PCT/US2018/031717 dated Aug. 23, 2018.

(Continued)

*Primary Examiner* — Patrick Hamo
*Assistant Examiner* — David N Brandt
(74) *Attorney, Agent, or Firm* — Armstrong Teasdale LLP

(57) ABSTRACT

A gas pulse jet pump for use with a fluid transfer system is provided. The gas pulse jet pump includes a main body including at least one suction chamber configured to receive production fluid. The gas pulse jet pump further includes an inlet configured to receive the production fluid into the gas pulse jet pump, at least one valve configured to regulate flow of the production fluid through the gas pulse jet pump, at least one gas injection port configured to intermittently inject high pressure gas into the at least one suction chamber, and an outlet configured to receive the production fluid from the at least one suction chamber and discharge the production fluid from the gas pulse jet pump.

20 Claims, 4 Drawing Sheets

(51) Int. Cl.
*E21B 34/16* (2006.01)
*F04F 5/44* (2006.01)

(58) Field of Classification Search
CPC .... E21B 43/122; E21B 43/123; E21B 43/124; E21B 43/129
See application file for complete search history.

(56) References Cited

U.S. PATENT DOCUMENTS

| | | | | |
|---|---|---|---|---|
| 6,354,371 | B1 | 3/2002 | O'Blanc | |
| 6,497,287 | B1 | 12/2002 | Podio et al. | |
| 7,063,161 | B2 | 6/2006 | Butler et al. | |
| 7,770,772 | B2 * | 8/2010 | Adams | B25F 5/008 123/46 SC |
| 8,257,055 | B2 | 9/2012 | Beg et al. | |
| 8,789,609 | B2 | 7/2014 | Smith et al. | |
| 2002/0182084 | A1 | 12/2002 | Gonzalez et al. | |
| 2014/0341755 | A1 | 11/2014 | Laing et al. | |
| 2015/0000926 | A1 | 1/2015 | Beg et al. | |
| 2015/0096756 | A1 | 4/2015 | Sharma et al. | |
| 2015/0167652 | A1 * | 6/2015 | Van Dam | E21B 43/126 417/53 |
| 2017/0107807 | A1 | 4/2017 | Saponja et al. | |

OTHER PUBLICATIONS

Cunningham et al., "Jet Breakup and Mixing Throat Lengths for the Liquid Jet Gas Pump"; Sep. 1, 1974; 11 pages; vol. 96; Issue 3, Journal of Fluids Engineering.

Nunez Pino et al.; "Gas Lift-Jet Pump Hybrid Completion Reduces Nonproductive Time During Unconventional Well Production"; 2016; 9 pages; SPE Argentina Exploration and Production of Unconventional Resources Symposium, Jun. 1-3, Buenos Aires, Argentina.

* cited by examiner

SYSTEMS AND METHODS FOR GAS PULSE JET PUMP

BACKGROUND

The field of the disclosure relates generally to artificial lift technology and, more specifically, to methods and systems for a gas pulse jet pump that leverages the benefits of traditional jet pump and gas lift technologies Gas lift systems use the injection of gas into a production well to increase the flow of liquids, such as crude oil or water, from the production well. Gas is injected down the casing and ultimately into the tubing of the well at one or more downhole locations to reduce the weight of the hydrostatic column. This effectively reduces the density of the fluid in the well and further reduces the back pressure, allowing the reservoir pressure to lift the fluid out of the well. As the gas rises, the bubbles help to push the fluid ahead. The produced fluid can be oil, water, or a mix of oil and water, typically mixed with some amount of gas.

Hydraulic jet pumps, also known as water jet pumps use liquid jet energy to displace fluids while at the same time generating suction to reduce the pressure within the wellbore. The advantages of hydraulic jet pumps include: no moving parts, no mechanical or electrical connections, operates in unlimited depth and well deviation, and operates in harsh conditions. However, hydraulic jet pump technology uses the transfer of momentum from a viscous fluid to another, resulting in frictional losses that yield a relatively inefficient mode of fluid transport. For example, overall system efficiencies for hydraulic jet pump technology can range from approximately ten to approximately thirty percent.

Gas lift operations are exposed to a wide range of conditions. These vary by well location, reservoir type, etc. Furthermore, well conditions, such as downhole pressure, may change over time. Therefore ideal operating conditions of the well may change over time. Gas lift systems usually are applied in vertical section of wells and the wells experience high back pressure on the reservoir. This makes gas lift application impractical in low reservoir pressure assets. Typically, the use of gas lift in well laterals is impractical. In contrast, hydraulic jet pumps perform consistently, but are inefficient. One solution can be using gas rather than liquid as the power fluid in a jet pump. The challenge is continuous injection of gas jets in well laterals. This results in gas occupying the wellbore space and restricting the inflow from the reservoir instead of generating suction. Due to the compressible nature of the displacing fluid, the energy does not transfer efficiently and the gas compresses rather than propelling liquids from the wellbore. The gravity force also causes gas to override the liquid in the well laterals instead of displacing the liquids.

BRIEF DESCRIPTION

In one aspect, a gas pulse jet pump for use with a fluid transfer system is provided. The gas pulse jet pump includes a main body including at least one suction chamber configured to receive production fluid. The gas pulse jet pump further includes an inlet configured to receive the production fluid into the gas pulse jet pump, at least one valve configured to regulate flow of the production fluid through the gas pulse jet pump, at least one gas injection port configured to intermittently inject high pressure gas into the at least one suction chamber, and an outlet configured to receive the production fluid from the at least one suction chamber and discharge the production fluid from the gas pulse jet pump.

In a further aspect, a fluid transfer system is provided. The fluid transfer system includes a compressor configured to compress low pressure gas into high pressure gas, a tubing system configured to transport the high pressure gas and production fluid through said fluid transfer system, and a gas pulse jet pump. The gas pulse jet pump includes a main body including at least one suction chamber configured to receive production fluid. The gas pulse jet pump further includes an inlet configured to receive the production fluid into the gas pulse jet pump, at least one valve configured to regulate flow of the production fluid through the gas pulse jet pump, at least one gas injection port configured to intermittently inject high pressure gas into the at least one suction chamber, and an outlet configured to receive the production fluid from the at least one suction chamber and discharge the production fluid from the gas pulse jet pump.

In another aspect, a method of assembling a gas pulse jet pump is provided. The method includes providing a main body, forming at least one suction chamber in the main body. The at least one suction chamber is configured to receive production fluid. The method further includes forming an inlet configured to receive the production fluid, and providing at least one valve configured to regulate the flow of the production fluid through the gas pulse jet pump. In addition, the method includes providing at least one gas injection port configured to intermittently inject high pressure gas into the at least one suction chamber, and forming an outlet configured to receive the production fluid from the at least one suction chamber and discharge the production fluid from the gas pulse jet pump.

DRAWINGS

These and other features, aspects, and advantages of the present disclosure will become better understood when the following detailed description is read with reference to the accompanying drawings in which like characters represent like parts throughout the drawings, wherein.

Figure 1:
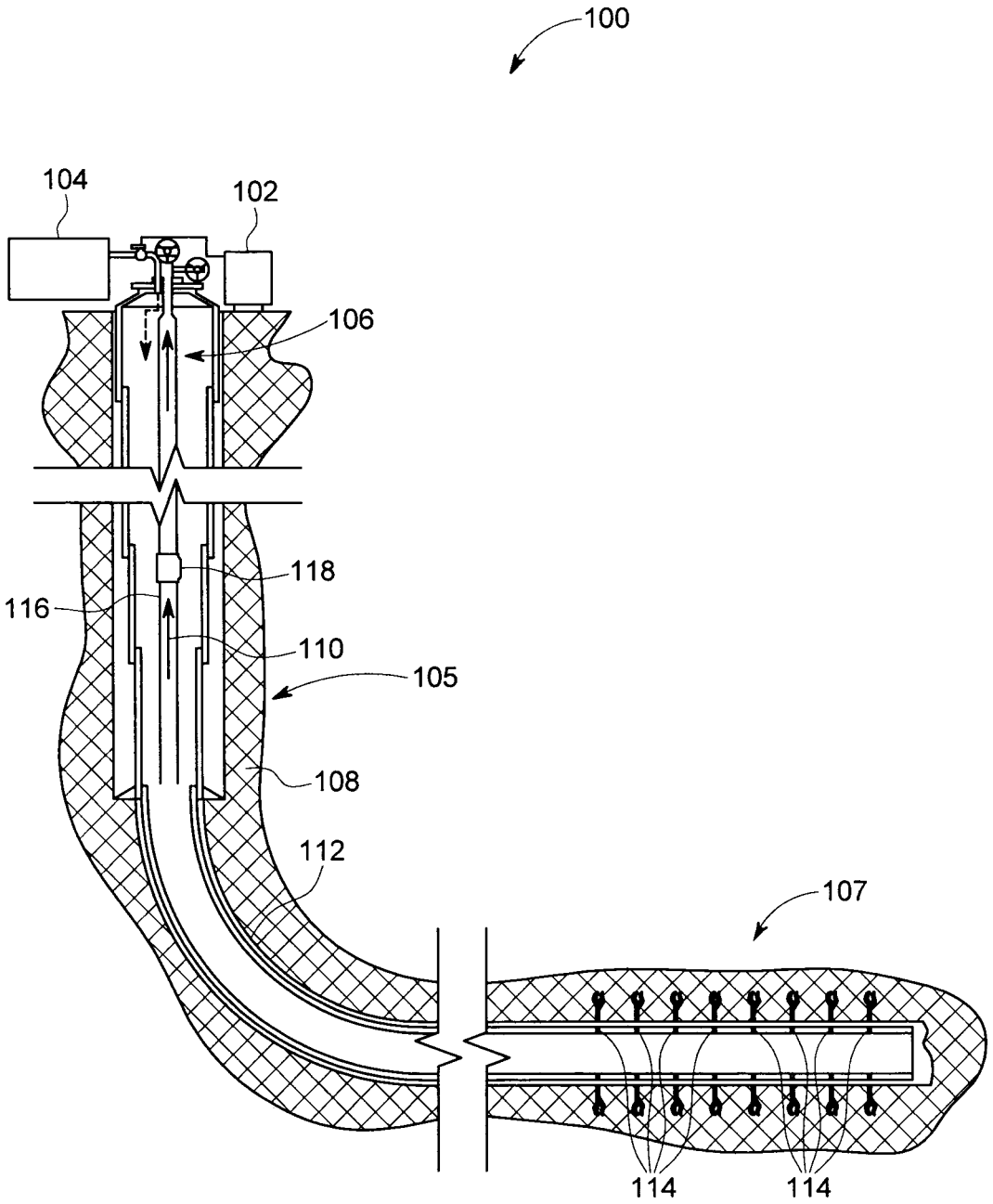
FIG. 1 is a schematic view of an exemplary gas lift system.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Embodiments of gas pulse jet pump devices described herein combine jet pumps and gas lift to facilitate improved operation in unconventional and horizontal wells. Specifically, the use of natural gas as the displacing fluid in jet pumps facilitates a reduction in backpressure of the reservoir. Additionally, the gas pulse jet pump facilitates an increase in reservoir drawdown. Additionally, the pump can be set in the horizontal section of the well. Moreover, the gas pulse jet pump facilitates an improvement in overall system efficiency. As such, the efficiency of the gas pulse jet pump system is higher when compared to hydraulic jet pumps due to natural gas lift in the vertical section of the well. Additionally, controlling the strength and frequency of gas jet pulses facilitates the implementation of the gas pulse jet pump as a unique artificial lift technology suitable for both low and high production rates. Additionally, the gas pulse jet pump can be used in low pressure reservoirs as a standalone lift technology, or in combination with other artificial lift technologies. The gas pulse jet pump makes it practical to use natural gas as the displacing fluid in jet pump applications, due to an intermittent gas injection scheme which results in a bubbly flow regime that efficiently transfers gas energy to the liquid and generates suction, thus making the use of gas as the displacing fluid in unconventional and horizontal wells efficient and practical.

FIG. 1 is a schematic view of an exemplary gas lift system 100. Gas lift system 100 includes a master controller 102 which is configured to control gas lift system 100. Gas lift system 100 further includes a compressor 104 configured to inject gas into a well 106. In the exemplary embodiment well 106 is a hole drilled into geological formation 108 for extracting production fluid 110, such as crude oil, water, or gas. Well 106 includes a vertical portion 105 extending downward into geological formation 108 and a lateral portion 107 extending horizontally from vertical portion 105. Well 106 is lined with a well casing 112. Well casing 112 may be positioned in any orientation within geological formation 108. A plurality of perforations 114 are formed through well casing 112 to permit production fluid 110 to flow into well 106 from geological formation 108. In operation, the gas is injected into well 106 and proceeds downhole. The injected gas induces a reduction in the density of one or more production fluids 110 in well 106, so that the reservoir pressure can be sufficient to push production fluid 110 up production string 116. In the exemplary embodiment, one or more gas lift valves 118 assist the flow of fluids 110 up a production string 116.

Figure 2:
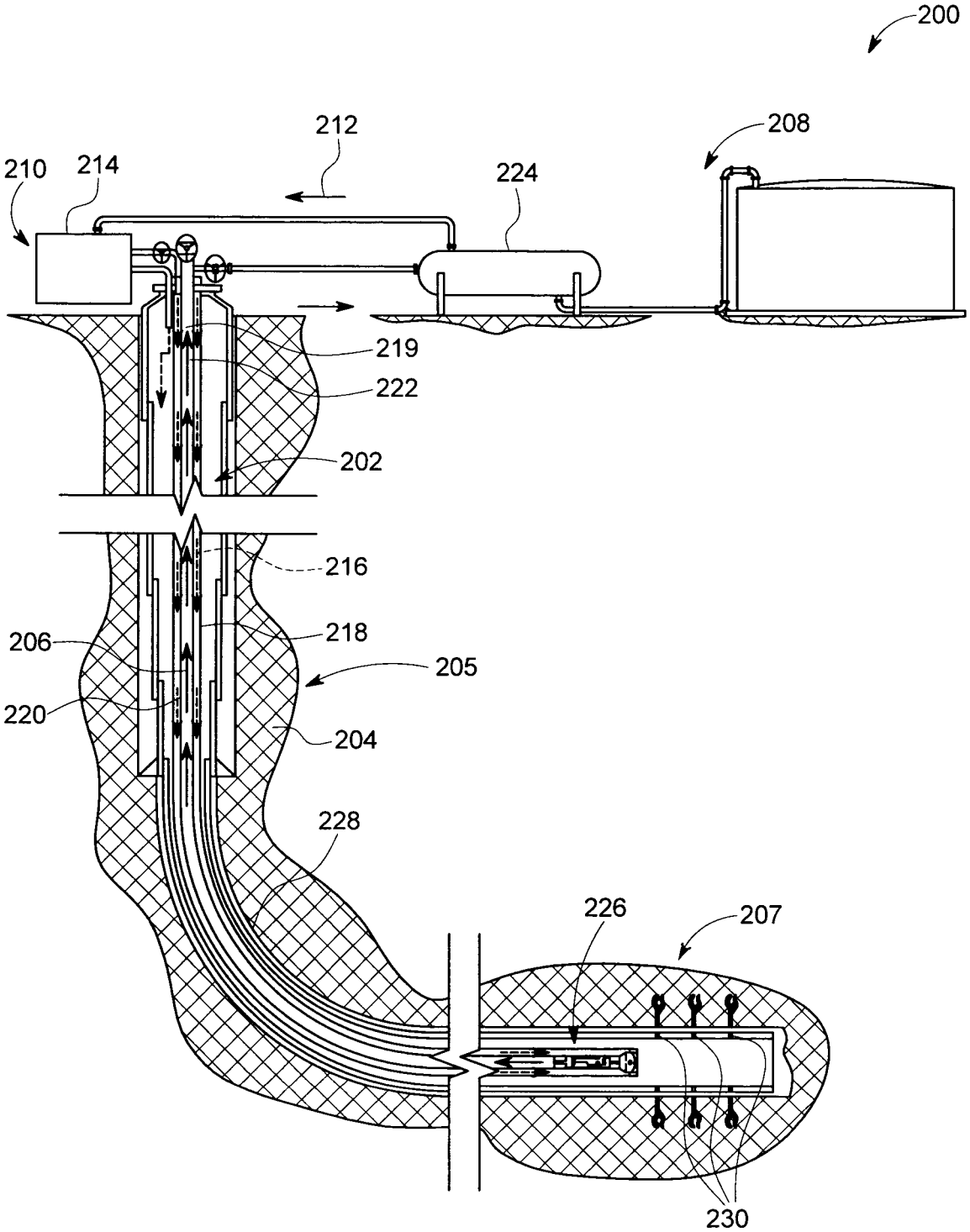
FIG. 2 is a schematic view of an exemplary gas pulse jet pump system.

FIG. 2 is a schematic view of a resource recovery system 200. Resource recovery system 200 includes a well 202 implanted within a geological formation 204 and configured to receive production fluid 206 from geological formation 204. Well 202 includes a vertical portion 205 extending downward into geological formation 204 and a lateral portion 207 extending horizontally from vertical portion 205. Resource recovery system 200 further includes a topside production location 208 coupled to well 202 and configured to receive production fluid 206 from well 202, and fluid transfer system 210. In one embodiment, fluid transfer system 210 includes low pressure gas 212, a compressor 214 configured to compress low pressure gas 212, high pressure gas 216 supplied by compressor 214, outer tubing 218 configured to transport high pressure gas 216 through fluid transfer system 210, and inner tubing 220 configured to transport production fluid 206 through fluid transfer system 210. Outer and inner tubing 218 and 220 form a tubing system 219 configured to transport high pressure gas 216 and production fluid 206 through fluid transfer system 210. Fluid transfer system 210 further includes production tubing 222 which is configured to transport production fluid 206 to be separated from low pressure gas 212, a fluid separator 224 that receives production fluid 206 from production tubing 222 and separates low pressure gas 212 from production fluid 206, and a gas pulse jet pump 226.

In the exemplary embodiment well 202 is a hole drilled into geological formation 204 for extracting production fluid 206, such as crude oil, water, or gas. Well 202 is lined with a well casing 228. Well casing 228 may be positioned in any orientation within geological formation 204. A plurality of perforations 230 are formed through well casing 228 to permit production fluid 206 to flow into well 202 from geological formation 204. In operation, low pressure gas is delivered to compressor 214 where it is compressed into high pressure gas 216 and injected into well 202 and proceeds downhole. High pressure gas 216 travels through outer tubing 218 to gas pulse jet pump 226 where it is then utilized by gas pulse jet pump 226 to displace production fluids 206 from within well 202. Gas pulse jet pump 226 pushes production fluids 206 up inner tubing 220. Production fluids 206 exit well 202 through production tubing 222 and is transported to fluid separator 224. Fluid separator 224 receives production fluid 206 from production tubing 222 and separates low pressure gas 212 from production fluid 206. Production fluid 206 is then processed, transported, or stored by topside production location 208 while low pressure gas is routed back to compressor 214 for use in recovering additional production fluid 206 from well 202.

Figure 3:
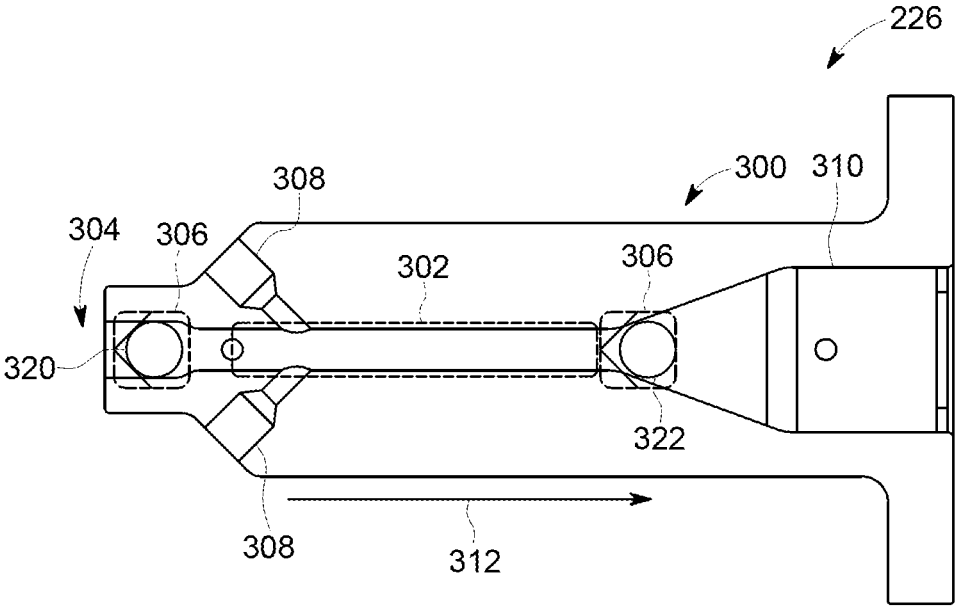
FIG. 3 is a cross-sectional view of the main body of the gas pulse jet pump, shown in FIG. 2.

FIG. 3 is a cross-sectional view of gas pulse jet pump 226. In one embodiment, gas pulse jet pump 226 includes a main body 300 defining one or more suction chambers 302 configured to fill with production fluid 206 (shown in FIG. 2). In the present embodiment, main body 300 defines a single suction chamber 302 configured to fill with production fluid 206. In the present embodiment, main body 300 defines a single suction chamber 302. However, in alternative embodiments, main body 300 may define more than one suction chamber 302. Gas pulse jet pump 226 further includes an inlet 304 configured to receive production fluid 206 into gas pulse jet pump 226, one or more valves 306 configured to regulate the flow of production fluid 206 through gas pulse jet pump 226, one or more gas injection ports 308 configured to intermittently inject gas, such as high pressure gas 216 (shown in FIG. 2) into suction chamber 302, and an outlet 310 configured to receive and discharge production fluid 206 out of gas pulse jet pump 226 into fluid transfer system 210. A valve, such as valve 306, can be any device configured to regulate, direct, or control the flow of fluid through the openings and passageways of gas pulse jet pump 226.

In operation, production fluid 206 (shown in FIG. 2) flows into gas pulse jet pump 226 through inlet 304. Production fluid 206 flows in a direction 312 through gas pulse jet pump 226. Inlet 304 is in fluid communication with both fluid transfer system 210 (shown in FIG. 2) and suction chamber 302. Production fluid 206 then flows into suction chamber 302 until suction chamber 302 is full. Suction chamber 302 is in fluid communication with both inlet 304 and outlet 310. Suction chamber 302 is configured to receive production fluid 206 from inlet 304, and discharge production fluid 206 into outlet 310. High pressure gas 216 (shown in FIG. 2) then enters gas pulse jet pump 226 through gas injection ports 308. One or more gas injection ports 308 are disposed within main body 300 adjacent to suction chamber 302. One or more gas injection ports 308 are in fluid communication with fluid transfer system 210 and suction chamber 302, and are configured to facilitate the flow of production fluid 206 in the direction 312 of outlet 310. Gas injection ports 308 are in fluid communication with fluid transfer system 210 by way of outer tubing 218 (shown in FIG. 2), which supplies high pressure gas 216 to gas injection ports 308.

In operation, gas injection ports 308 intermittently inject high pressure gas 216 (shown in FIG. 2) into suction chamber 302. The intermittent gas injection scheme results in a bubbly flow regime that facilitates the use of high pressure gas 216 as the displacing fluid in gas pump jet 226. High pressure gas 216 acts as a gas pocket piston, pushing production fluid 206 (shown in FIG. 2) from suction chamber 302 into outlet 310 as the volume of the injected gas bubble expands. Outlet 310 is in fluid communication with suction chamber 302 and fluid transfer system 210 (shown in FIG. 2). Outlet 310 is in fluid communication with fluid transfer system 210 by way of inner tubing 220, which facilitates transporting production fluid 206 upwell from gas pulse jet pump 226. After production fluid 206 moves from suction chamber 302 into outlet 310, production fluid 206 is transported upwell by inner tubing 220 (shown in FIG. 2). In alternative embodiments, the fluids carried by the inner tubing 220 and outer tubing 218 may be switched, such that inner tubing 220 carries high pressure gas 216 and outer tubing 220 carries production fluid 206. Additionally, in alternative embodiments, tubing system 219 may include a single tube used within the wellbore, and may be configured such that compressed gas is transferred through the annular space between the wellbore casing and the single tube, and production fluid travels through the single tube and (vice versa).

In operation, once production fluid 206 (shown in FIG. 2) evacuates suction chamber 302, the gas injection is then interrupted, sucking production fluid 206 from inlet 304 into suction chamber 302. One or more valves 306 are disposed within main body 300 and are configured to regulate the flow of production fluid 206 as it moves between at least one of inlet 304 and suction chamber 302, and suction chamber 302 and outlet 310. The movement of production fluid 206 and injection of high pressure gas 216 (shown in FIG. 2) facilitates the opening and closing of valves 306. The gas injection process is repeated once suction chamber 302 is filled with liquid. This interrupted injection scheme results in a bubbly flow regime that is able to efficiently transfer the gas jet energy injected by gas injection ports 308 to production fluid 206 and generate the suction necessary to move production fluid 206 from inlet 304 into suction chamber 302.

Additionally, in one embodiment, as the gas pocket piston forces production fluid 206 (shown in FIG. 2) from suction chamber 302 into outlet 310, a first valve 320 closes, preventing production fluid 206 and high pressure gas 216 from flowing back into inlet 304. Once the injection of high pressure gas 216 (shown in FIG. 2) ceases, first valve 320 opens, allowing production fluid 206 to flow from inlet 304 into suction chamber 302. In another embodiment, as the gas pocket piston forces production fluid 206 from suction chamber 302 into outlet 310, a second valve 322 opens, facilitating the transfer of production fluid 206 from suction chamber 302 into outlet 310. After the injection of high pressure gas 216 ceases, second valve 322 closes, which prevents the backflow of production fluid 206 from outlet 310 into suction chamber 302. This allows production fluid 206 from inlet 304 to fill suction chamber 302. In yet another embodiment, one or more valves 306 may simultaneously or alternatively regulate the flow of production fluid 206 in direction 312 through gas pulse jet pump 226. Valves 306 may alternate between opening and closing. As first valve 320 opens to permit production fluid 206 to flow into suction chamber 302 from inlet 304, second valve 322 closes to prevent production fluid 206 from flowing back into suction chamber 302 from outlet 310.

Figure 4:
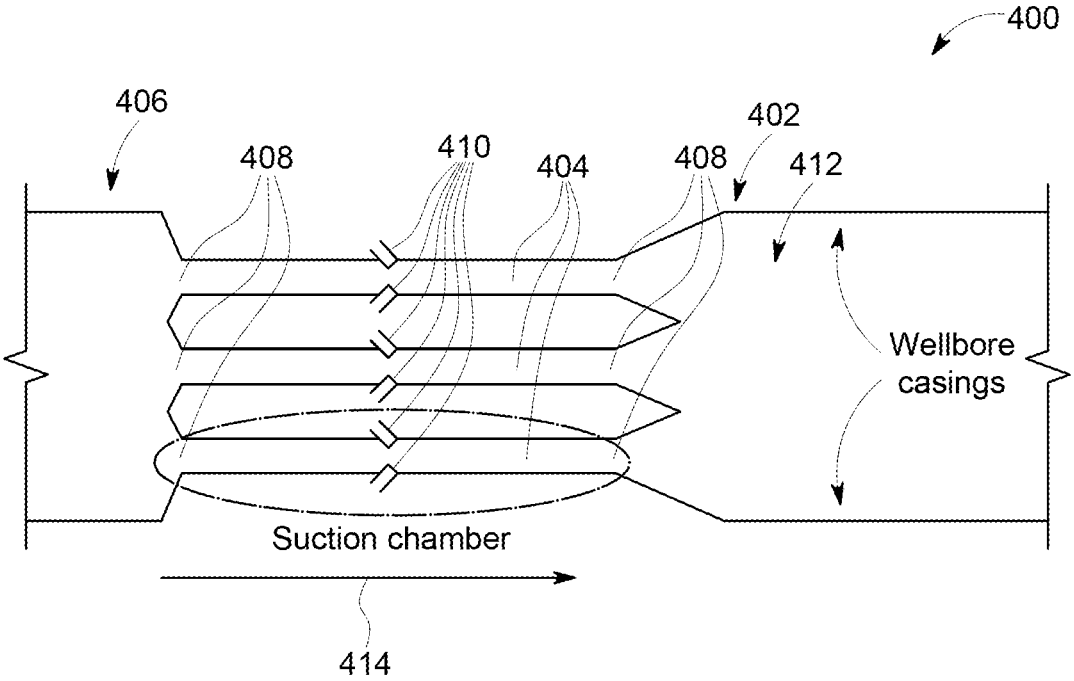
FIG. 4 is a schematic view of an embodiment of a gas pulse jet pump having multiple suction chambers.

FIG. 4 is a schematic view of an embodiment of a gas pulse jet pump 400 having multiple suction chambers. In the present embodiment, gas pulse jet pump 400 includes a main body 402 defining three suction chambers 404 configured to fill with production fluid 206 (shown in FIG. 2). In this embodiment, main body 402 defines three suction chambers 404, however, in alternative embodiments, main body 400 may define more or less suction chambers. Gas pulse jet 400 further includes an inlet 406 configured to receive production fluid 206 into gas pulse jet pump 400, one or more valves 408 configured to regulate the flow of production fluid 206 through gas pulse jet pump 400, one or more gas injection ports 410 are configured to inject gas, such as high pressure gas 216 (shown in FIG. 2) into suction chambers 404, and an outlet 412 configured to receive and discharge production fluid 206 out of gas pulse jet pump 400 into fluid transfer system 210. A valve, such as valve 408, can be any device configured to regulate, direct, or control the flow of fluid through the openings and passageways of gas pulse jet pump 400.

In operation, production fluid 206 (shown in FIG. 2) flows into gas pulse jet pump 400 through inlet 406. Production fluid 206 flows in a direction 414 through gas pulse jet pump 400. Inlet 406 is in fluid communication with both fluid transfer system 210 (shown in FIG. 2) and suction chambers 404. Production fluid 206 then flows into suction chambers 404 until they are full. Suction chambers 404 are in fluid communication with both inlet 406 and outlet 412. Suction chambers 404 are configured to receive production fluid 206 from inlet 406, and discharge production fluid 206 into outlet 412. High pressure gas 216 (shown in FIG. 2) then enters gas pulse jet pump 400 through gas injection ports 410. One or more gas injection ports 410 are disposed within main body 402 adjacent to suction chambers 404. One or more gas injection ports 410 are in fluid communication with fluid transfer system 210 and suction chambers 404, and are configured to facilitate the flow of production fluid 206 in the direction 414 of outlet 412. Gas injection ports 410 are in fluid communication with fluid transfer system 210 by way of outer tubing 218 (shown in FIG. 2), which supplies high pressure gas 216 to gas injection ports 410.

In operation, gas injection ports 410 intermittently inject high pressure gas 216 (shown in FIG. 2) into suction chambers 404. The intermittent gas injection scheme results in a bubbly flow of high pressure gas 216 that facilitates the use of high pressures gas 216 as the displacing fluid in gas pump jet 400. High pressure gas 216 then acts as a gas pocket piston, pushing production fluid 206 (shown in FIG. 2) from suction chambers 404 into outlet 412. Outlet 412 is in fluid communication with suction chambers 404 and fluid transfer system 210 (shown in FIG. 2). Outlet 412 is in fluid communication with fluid transfer system 210 by way of inner tubing 220 (shown in FIG. 2), which facilitates transporting production fluid 206 upwell from gas pulse jet pump 400. After production fluid 206 moves from suction chambers 404 into outlet 412, it is then transported upwell by inner tubing 220.

In operation, once production fluid 206 (shown in FIG. 2) evacuates suction chambers 404, the gas injection is then interrupted, this sucks the liquid from inlet 406 into suction chambers 404. One or more valves 408 are disposed within main body 402 and are configured to regulate the flow of production fluid 206 as it moves between at least one of inlet 406 and suction chambers 404, and suction chambers 404 and outlet 412. The movement of production fluid 206 and injection of high pressure gas 216 (shown in FIG. 2) facilitates the opening and closing of valves 408. Valves 408 operate substantially similar to valves 306 (shown in FIG. 3). The gas injection process is repeated once suction chambers 404 are filled with liquid. This interrupted injection scheme results in a bubbly flow regime that is able to efficiently transfer the gas jet energy injected by gas injection ports 410 to production fluid 206 and generate the suction necessary to move production fluid 206 from inlet 406 into suction chambers 404.

Figure 5:
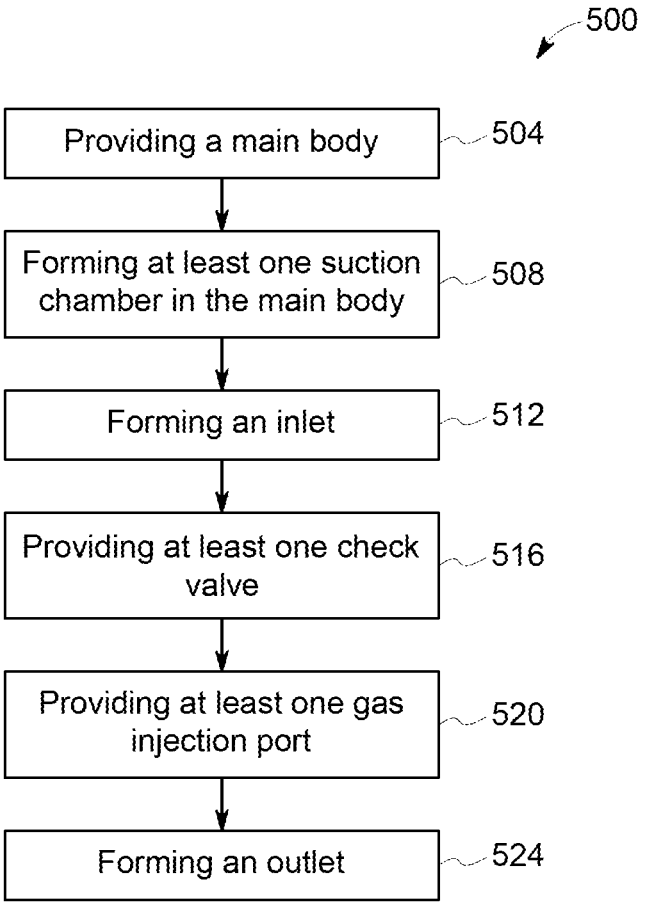
FIG. 5 is a flow chart illustrating a method of assembling the gas pulse jet pump shown in FIG. 2.

FIG. 5 is a flow chart illustrating a method 500 of assembling gas pulse jet pump 226 (shown in FIGS. 2 and 3). Method 500 includes providing 504 a main body 300 (shown in FIG. 3), and forming 508 at least one suction chamber 302 (shown in FIG. 3) in main body 300. Suction chamber 302 is configured to receive production fluid 206 (shown in FIG. 2). Method 500 further includes forming 512 an inlet 304 (shown in FIG. 3) configured to receive production fluid 206, and providing 516 at least one valve 306 configured to regulate the flow of production fluid 206 through gas pulse jet pump 226. In addition, method 500 includes providing 520 at least one gas injection port 308 (shown in FIG. 3) configured to intermittently inject high pressure gas 216 (shown in FIG. 2) into suction chamber 302, and forming 524 an outlet 310 (shown in FIG. 3) configured to receive production fluid 226 from suction chamber 302 and discharge production fluid 206 from gas pulse jet pump 226. In one embodiment, forming 508 at least one suction chamber 306 includes performing 528 drilling operations on the main body. In addition, forming 512 an inlet 304 includes performing 532 drilling operations through the outer surface of main body 300. Additionally, forming 516 an outlet 310 includes performing 536 drilling operations through the outer surface of the main body.

The gas pulse jet pump devices described herein combine jet pumps and gas lift to facilitate improved operation in unconventional and horizontal wells. Specifically, the use of natural gas as the displacing fluid in jet pumps facilitates a reduction in backpressure of the reservoir. Additionally, the gas pulse jet pump facilitates an increase in reservoir drawdown. Additionally, the pump can be set in the horizontal section of the well, resulting in a reduction of surface equipment needed to operate the well. Moreover, the gas pulse jet pump facilitates an improvement in overall system efficiency. As such, the efficiency of the gas pulse jet pump system is higher when compared to hydraulic jet pumps due to natural gas lift in the vertical section of the well. Additionally, controlling the strength and frequency of gas jet pulses facilitates the implementation of the gas pulse jet pump as a unique artificial lift technology suitable for both low and high production rates. Additionally, the gas pulse jet pump can be used in low pressure reservoirs as a standalone lift technology, or in combination with other artificial lift technologies. The gas pulse jet pump makes it practical to use natural gas as the displacing fluid in jet pump applications, due to an intermittent gas injection scheme which results in a bubbly flow regime that efficiently transfers gas energy to the liquid and generates suction, thus making the use of gas as the displacing fluid in unconventional and horizontal wells efficient and practical.

Exemplary embodiments of methods, systems, and apparatus for operating gas pulse jet pumps are not limited to the specific embodiments described herein, but rather, components of systems and/or steps of the methods may be utilized independently and separately from other components and/or steps described herein. For example, the methods, systems, and apparatus may also be used in combination with other systems requiring reducing particles in a fluid flow, and the associated methods, and are not limited to practice with only the systems and methods as described herein. Rather, the exemplary embodiment can be implemented and utilized in connection with many other applications, equipment, and systems that may benefit from artificial lift generated by gas pulse jet pumps.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas pulse jet pump for use with a fluid transfer system, said gas pulse jet pump comprising:

a main body comprising at least one suction chamber configured to receive production fluid;

an inlet oriented to receive the production fluid within a lateral portion of a production well for discharge into said gas pulse jet pump;

at least one gas injection port configured to intermittently inject a high pressure gas into said at least one suction chamber;

an outlet configured to receive the production fluid from said at least one suction chamber and discharge the production fluid from said gas pulse jet pump;

a first valve disposed within said main body downstream of said inlet and configured to regulate flow of the production fluid between said inlet and said suction chamber, said first valve configured to move between a first open position and a first closed position by movement of the production fluid and the injection of the high pressure gas, wherein said first valve is configured to move to the first open position and fill said at least one suction chamber with the production fluid in response to said at least one gas injection port ceasing injection of the high pressure gas; and a second valve disposed within said main body upstream of said outlet and configured to regulate flow of the production fluid between said outlet and said suction chamber, said second valve configured to move between a second open position and a second closed position by movement of the production fluid and the injection of the high pressure gas.

2. The gas pulse jet pump in accordance with claim 1, wherein said inlet is in fluid communication with the fluid transfer system and said at least one suction chamber.

3. The gas pulse jet pump in accordance with claim 1, wherein said at least one suction chamber is in fluid communication with said inlet and said outlet.

4. The gas pulse jet pump in accordance with claim 1, wherein said at least one suction chamber is configured to receive the production fluid from said inlet.

5. The gas pulse jet pump in accordance with claim 1, wherein said at least one suction chamber is configured to discharge the production fluid into said outlet.

6. The gas pulse jet pump in accordance with claim 1, wherein said at least one gas injection port is disposed within said main body.

7. The gas pulse jet pump in accordance with claim 1, wherein said at least one gas injection port is in fluid communication with the fluid transfer system and said at least one suction chamber, and is configured to facilitate the flow of the production fluid towards said outlet.

8. The gas pulse jet pump in accordance with claim 1, wherein said outlet is in fluid communication with said at least one suction chamber and the fluid transfer system.

9. The gas pulse jet pump in accordance with claim 1, wherein said outlet is configured to receive the production fluid from said at least one suction chamber and discharge the production fluid into the fluid transfer system.

10. A fluid transfer system comprising:

a compressor configured to compress a low pressure gas into a high pressure gas;

a tubing system configured to transport the high pressure gas and production fluid through said fluid transfer system; and a gas pulse jet pump comprising;

a main body comprising at least one suction chamber configured to receive the production fluid;

an inlet oriented to receive the production fluid within a lateral portion of a production well for discharge into said gas pulse jet pump;

at least one gas injection port configured to intermittently inject the high pressure gas into said at least one suction chamber;

an outlet configured to receive the production fluid from said at least one suction chamber and discharge the production fluid from said gas pulse jet pump;

a first valve disposed within said main body downstream of said inlet and configured to regulate flow of the production fluid between said inlet and said suction chamber, said first valve configured to move between a first open position and a first closed position by movement of the production fluid and the injection of the high pressure gas, wherein said first valve is configured to move to the first open position and fill said at least one suction chamber with the production fluid in response to said at least one gas injection port ceasing injection of the high pressure gas; and a second valve disposed within said main body upstream of said outlet and configured to regulate flow of the production fluid between said outlet and said suction chamber, said second valve configured to move between a second open position and a second closed position by movement of the production fluid and the injection of the high pressure gas.

11. The fluid transfer system in accordance with claim 10, wherein said inlet is in fluid communication with said fluid transfer system and said at least one suction chamber, and wherein said at least one suction chamber is in fluid communication with said inlet and said outlet.

12. The fluid transfer system in accordance with claim 10, wherein said at least one suction chamber is configured to receive the production fluid from said inlet, and wherein said at least one suction chamber is configured to discharge the production fluid into said outlet.

13. The fluid transfer system in accordance with claim 10, wherein said at least one gas injection port is disposed within said main body, and wherein said at least one gas injection port is in fluid communication with said fluid transfer system and said at least one suction chamber, and is configured to facilitate the flow of the production fluid towards said outlet.

14. The fluid transfer system in accordance with claim 10, wherein said outlet is in fluid communication with said at least one suction chamber and said fluid transfer system, and wherein said outlet is configured to receive the production fluid from said at least one suction chamber and discharge the production fluid into said fluid transfer system.

15. A method of assembling a gas pulse jet pump comprising:

providing a main body;

forming, using at least one drill, at least one suction chamber in the main body, the at least one suction chamber configured to receive production fluid;

forming, using the at least one drill, an inlet oriented to receive the production fluid within a lateral portion of a production well;

providing at least one gas injection port configured to intermittently inject high pressure gas into the at least one suction chamber;

forming, using the at least one drill, an outlet configured to receive the production fluid from the at least one suction chamber and discharge the production fluid from the gas pulse jet pump;

providing a first valve within the main body downstream of the inlet, the first valve configured to regulate flow of the production fluid between the inlet and the suction chamber, the first valve configured to move between a first open position and a first closed position by movement of the production fluid and the injection of the high pressure gas, wherein the first valve is configured to move to the first open position and fill the at least one suction chamber with the production fluid in response to the at least one gas injection port ceasing injection of the high pressure gas; and providing a second valve within the main body upstream of the outlet, the second valve configured to regulate flow of the production fluid between the outlet and the suction chamber, the second valve configured to move between a second open position and a second closed position by movement of the production fluid and the injection of the high pressure gas.

16. The method in accordance with claim 15, wherein forming the at least one suction chamber comprises performing drilling operations on the main body.

17. The method in accordance with claim 15, wherein forming the inlet comprises performing drilling operations through an outer surface of the main body.

18. The method in accordance with claim 15, wherein forming the outlet comprises performing drilling operations through an outer surface of the main body.

19. The gas pulse jet pump in accordance with claim 1, wherein said first valve is configured to move from the first open position to the first closed position if said at least one gas injection port injects the high pressure gas into said at least one suction chamber and said outlet discharges production fluid from said gas pulse jet pump, the first closed position preventing the production fluid and the high pressure gas from flowing from said suction chamber to said inlet.

20. The gas pulse jet pump in accordance with claim 1, wherein said second valve is configured to move from the second open position to the second closed position if said at least one gas injection port ceases injecting the high pressure gas into said at least one suction chamber, the second closed position preventing the production fluid and the high pressure gas from flowing from said suction chamber to said outlet.

* * * * *